United States Patent [19]

Carroll

[11] 3,951,265

[45] Apr. 20, 1976

[54] THREE-LEVEL STACKING CONTAINER

[75] Inventor: James C. Carroll, Bartlesville, Okla.

[73] Assignee: Phillips Petroleum Company, Bartlesville, Okla.

[22] Filed: July 29, 1974

[21] Appl. No.: 492,835

[52] U.S. Cl. ..... 206/506; 206/507

[51] Int. Cl.[2] ..... B65D 21/04; B65D 21/06

[58] Field of Search ..... 206/505, 506, 507

[56] References Cited

UNITED STATES PATENTS

| | | | |
|---|---|---|---|
| 2,964,217 | 12/1960 | Mickler | 206/506 |
| 3,375,953 | 4/1968 | Miller | 206/506 |
| 3,379,339 | 4/1968 | Asenbauer | 206/506 |
| 3,425,594 | 4/1969 | Bridenstine | 206/507 |
| 3,659,743 | 5/1972 | Box | 206/506 |
| 3,675,815 | 7/1972 | Rehrig | 206/507 |
| 3,819,044 | 6/1974 | Bockenstette | 206/507 |

*Primary Examiner*—George E. Lowrance

[57] ABSTRACT

A three-level stacking container adpated to stack within a lower container of like construction in a low-level stack position or an intermediate-stack position, or stack on said lower container in a high-stack position, depending upon the orientation of said upper container with respect to said lower container. Opposing first and second wall structures of said container comprise bar members which extend in an upwardly direction between a lower border flange and an upper rim. Said bar members are arranged such that the bar members of an upper container parallel the bar members of a lower container when said upper container is stacked within said lower container. If desired, "blind stacking" means can be provided for blind stacking the containers at said low-level stack position and said intermediate-level stack position.

18 Claims, 16 Drawing Figures

THREE-LEVEL STACKING CONTAINER

This invention relates to a three-level stacking container.

Nesting and stacking containers are well known in the art. In general, such containers comprise an open top, commonly rectangular, container so constructed that in one position of orientation an upper container will nest within a like oriented identical lower container for storage purposes. Commercially available nest and stack containers of the prior art commonly nest substantially completely within another like container. This is desirable for storage purposes, but is of little value for utility. When an upper container is rotated to another position of orientation it will stack vertically on said lower container, usually on top or essentially on top of the lower container.

Nest and stack containers are being employed in increasing numbers in a wide variety of applications such as product containers in the baking industry, lug boxes in the fruit and vegetable industry, storage bins for parts, etc. In many of these uses it will be desirable to have a container which can be usefully stacked with another container at more than one level or elevation. Such a container would have much greater utility than a container which can be stacked on another container at only one level or elevation.

The present invention solves this problem by providing a container which can be usefully stacked with another like container at three different levels or elevations. For example, in one position of orientation of an upper container with respect to a like lower container, an upper container of the invention will stack within a said like lower container at a low-stack position or relationship. In this position the bottom of the upper container is above the bottom of the lower container a significant distance sufficient to provide worthwhile utility for transporting products having a low height. Then, in a second position of orientation said upper container will stack within said lower container in an intermediate-stack position or relationship. In this position the bottom of the upper container is above the bottom of the lower container a greater distance, leaving more room for products having a greater height. Means are also provided for stacking an upper container on top of a lower container. In this position maximum utilization of the container interior is possible. Thus, for example, a bakery operator can employ the containers of the invention in multiple uses, and eliminate the need for stocking several different types of containers for different types of products. Other advantages of the containers of the invention will be discussed below in connection with the more detailed description of the containers.

Thus, according to the invention, there is provided a generally rectangular, three-level stacking, container, comprising a generally horizontally disposed bottom; opposed first and second wall structures respectively projecting upwardly from opposed first and second sides of said bottom; each of said wall structures comprising a lower border flange, an upper rim, a plurality of spaced apart bar members extending in an upwardly direction between said flange and said rim, a plurality of stacking feet provided at spaced apart locations along said flange, a plurality of stacking saddles provided at spaced apart locations along said rim, and a bail member pivotally mounted on said rim; said bail member being adapted to pivot to a position internal of and transverse said container so as to support a second container thereon in a high-stack position; the location, arrangement, and directional disposition of said bar members of said first wall structure and said bar members of said second wall structure with respect to each other and with respect to the locations and spacings of said stacking feet and stacking saddles being such that an upper said container will stack within a like lower container and on said border flange thereof in a low-stack position when said upper container is in one of the positions of (1) identical orientation with respect to said lower container and (2) rotated orientation with respect to said lower container; and said stacking feed and said stacking saddles of said wall structures being adapted to register and support an upper said container within a like lower container in an intermediate-stack position when said upper container is in the other of said positions (1) and (2).

Figure 4:
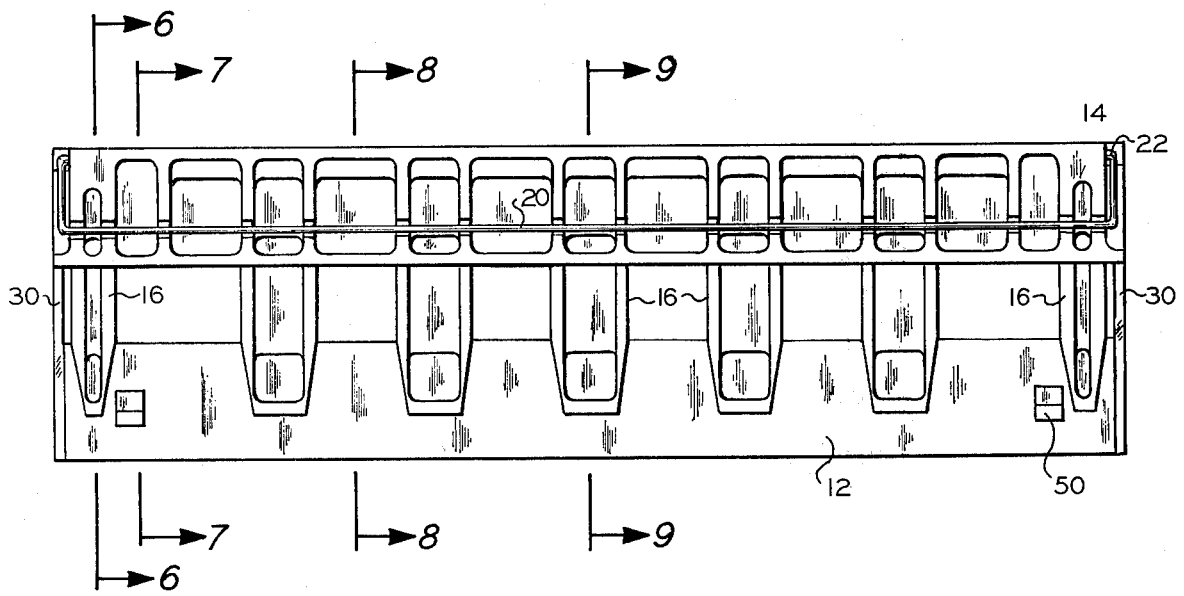
FIG. 4 is an end elevation view of one end of the container of FIG. 1.
Figure 5:
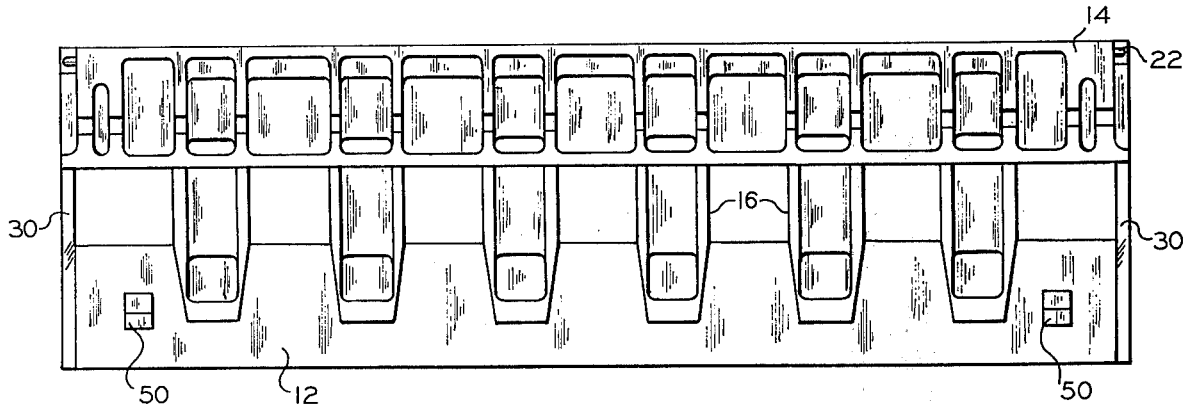
FIG. 5 is an end elevation view of the opposite end of the container of FIG. 1.
Figure 9:
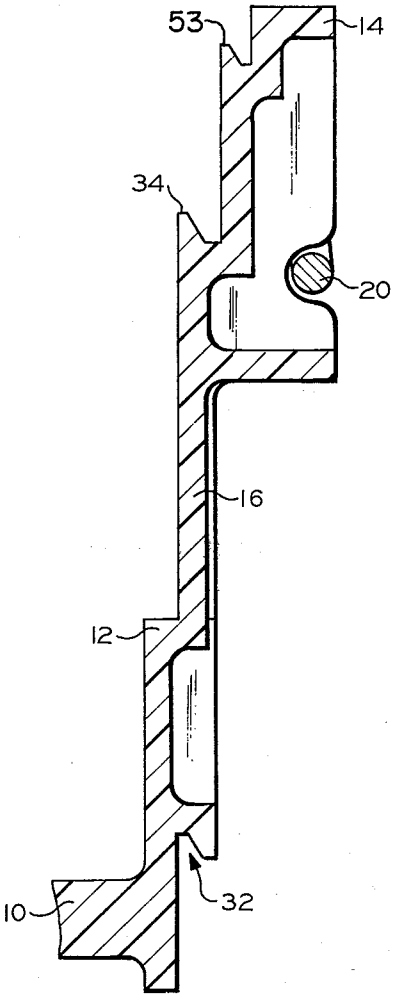
Figure 8:
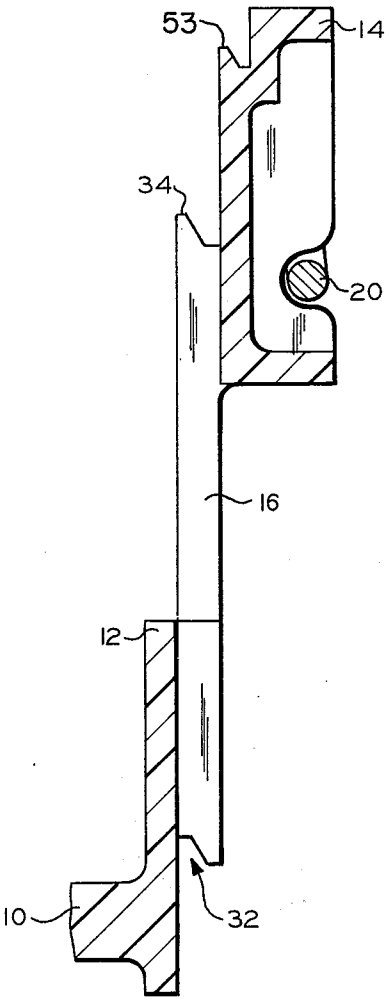
Figure 7:
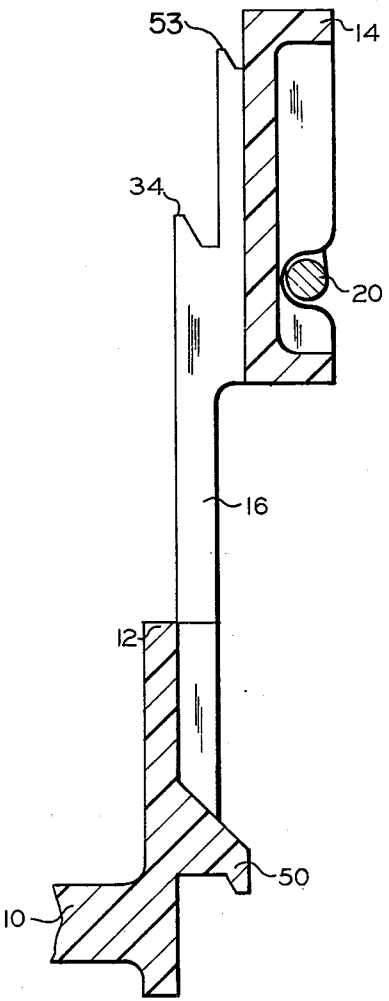
Figure 6:
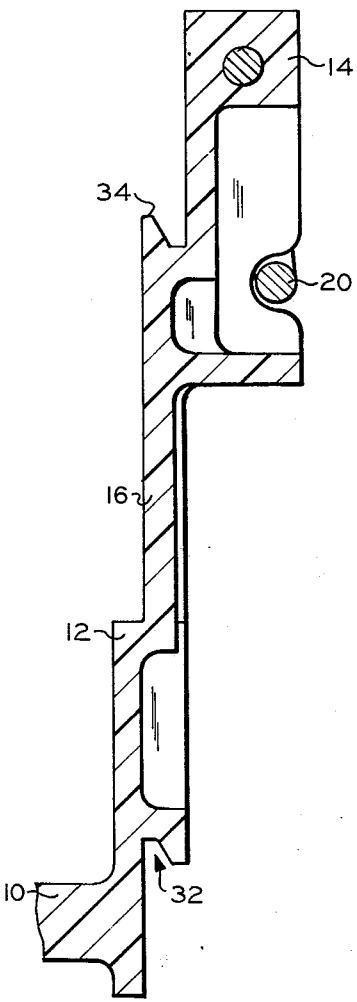

FIGS. 6, 7, 8, and 9 are enlarged sectional views taken along the lines 6—6, 7—7, 8—8, and 9—9, respectively, of FIG. 4.

Figure 10:
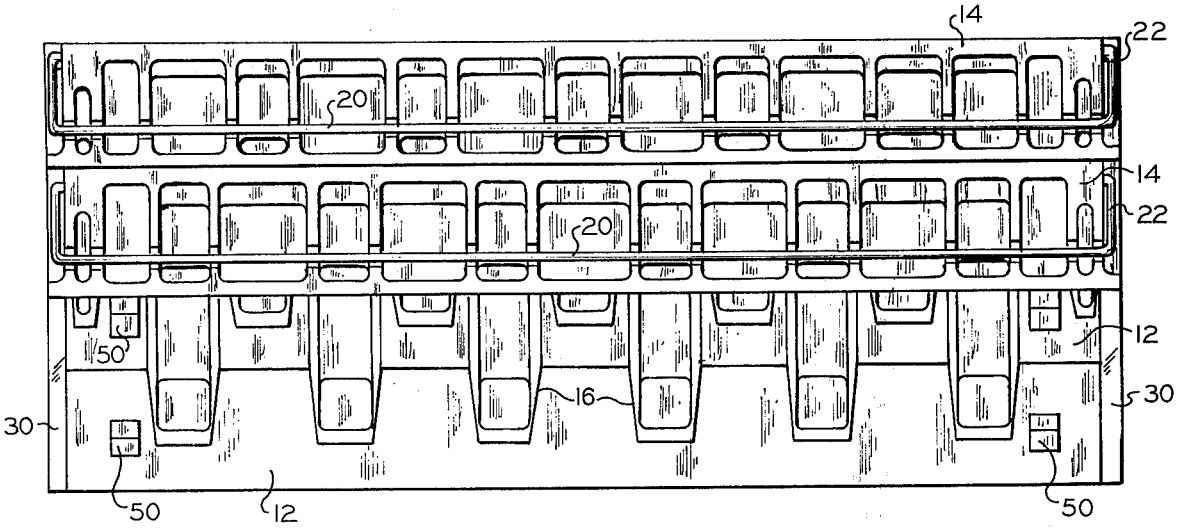

FIG. 10 is an end elevation view illustrating two containers of the invention in low-stack relationship.

Figure 11:
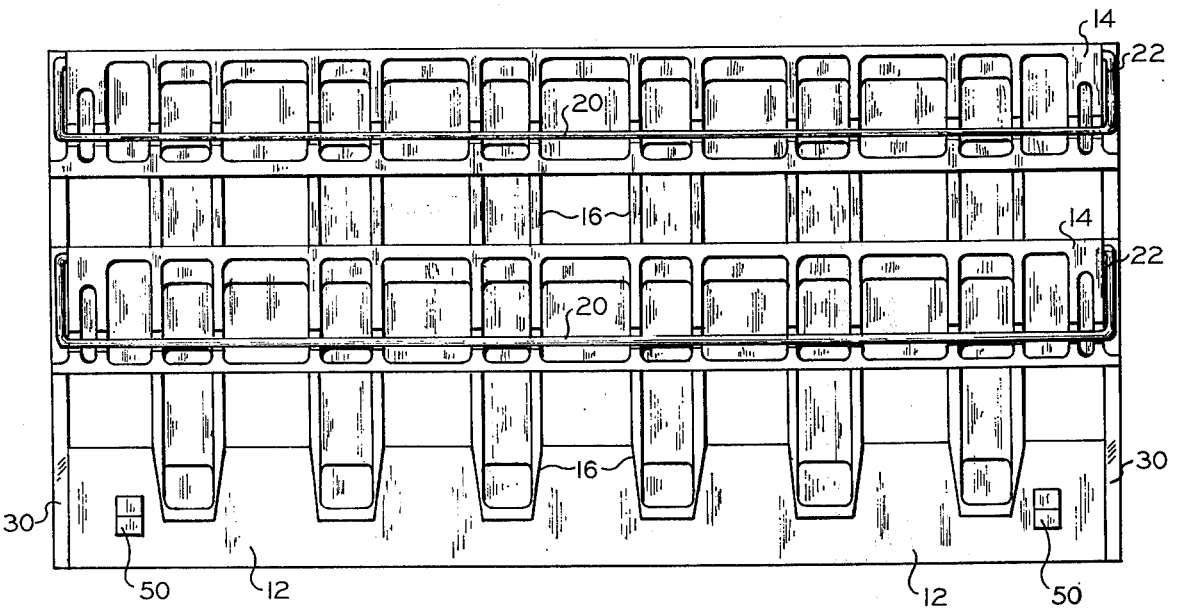

FIG. 11 is an end elevation view illustrating two containers of the invention in intermediate-stack relationship.

Figure 12:
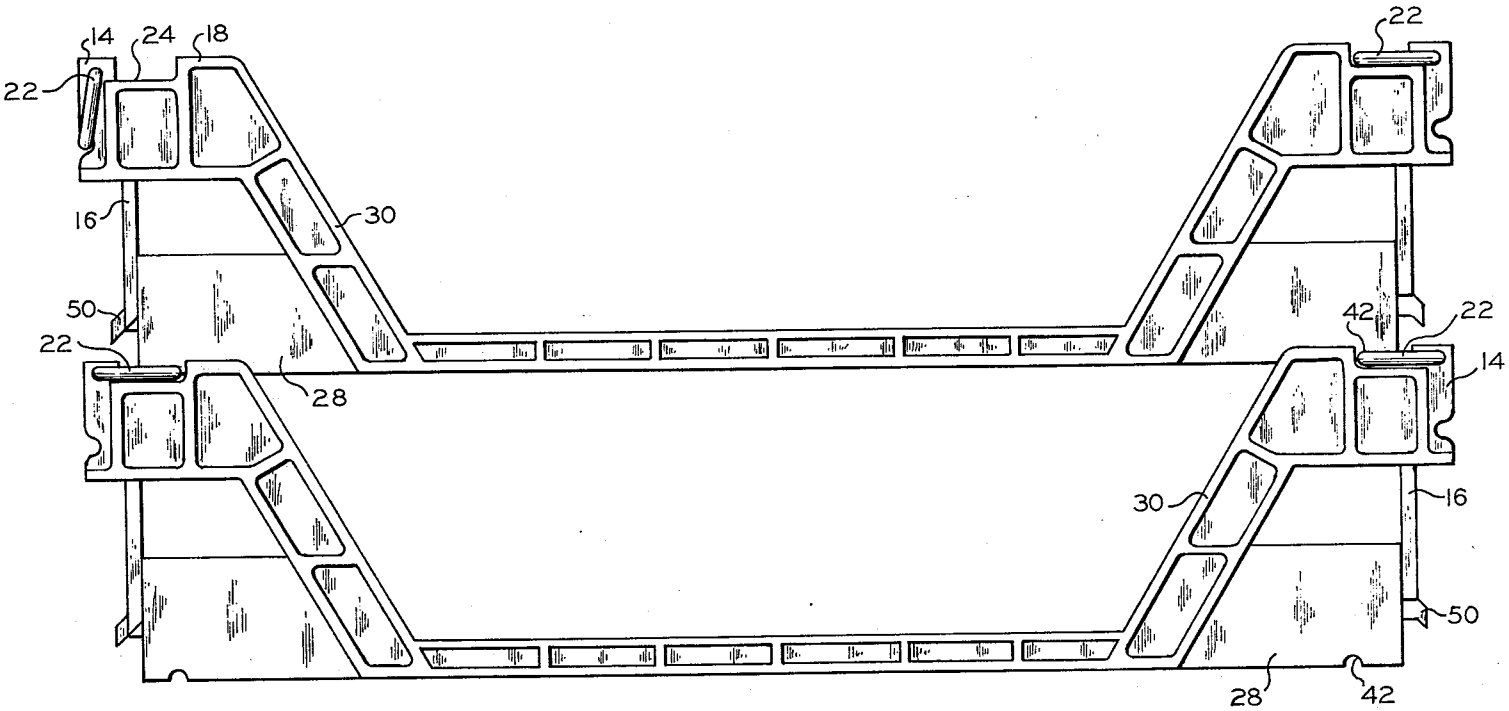

FIG. 12 is a side elevation view illustrating two containers of the invention in high-stack relationship.

Figure 1:
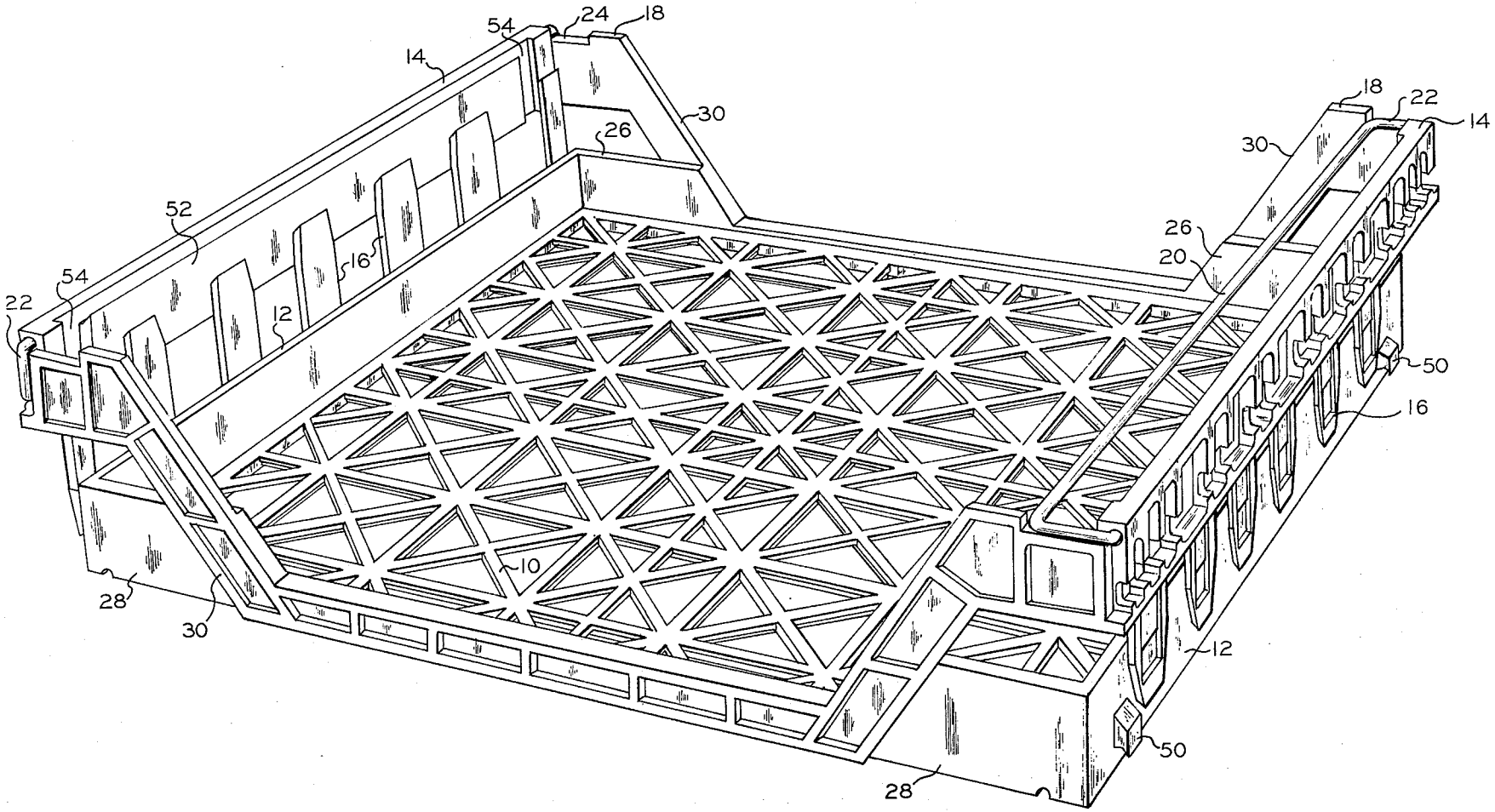
FIG. 1 is a top perspective view of one presently preferred container of the invention.
Figure 2:
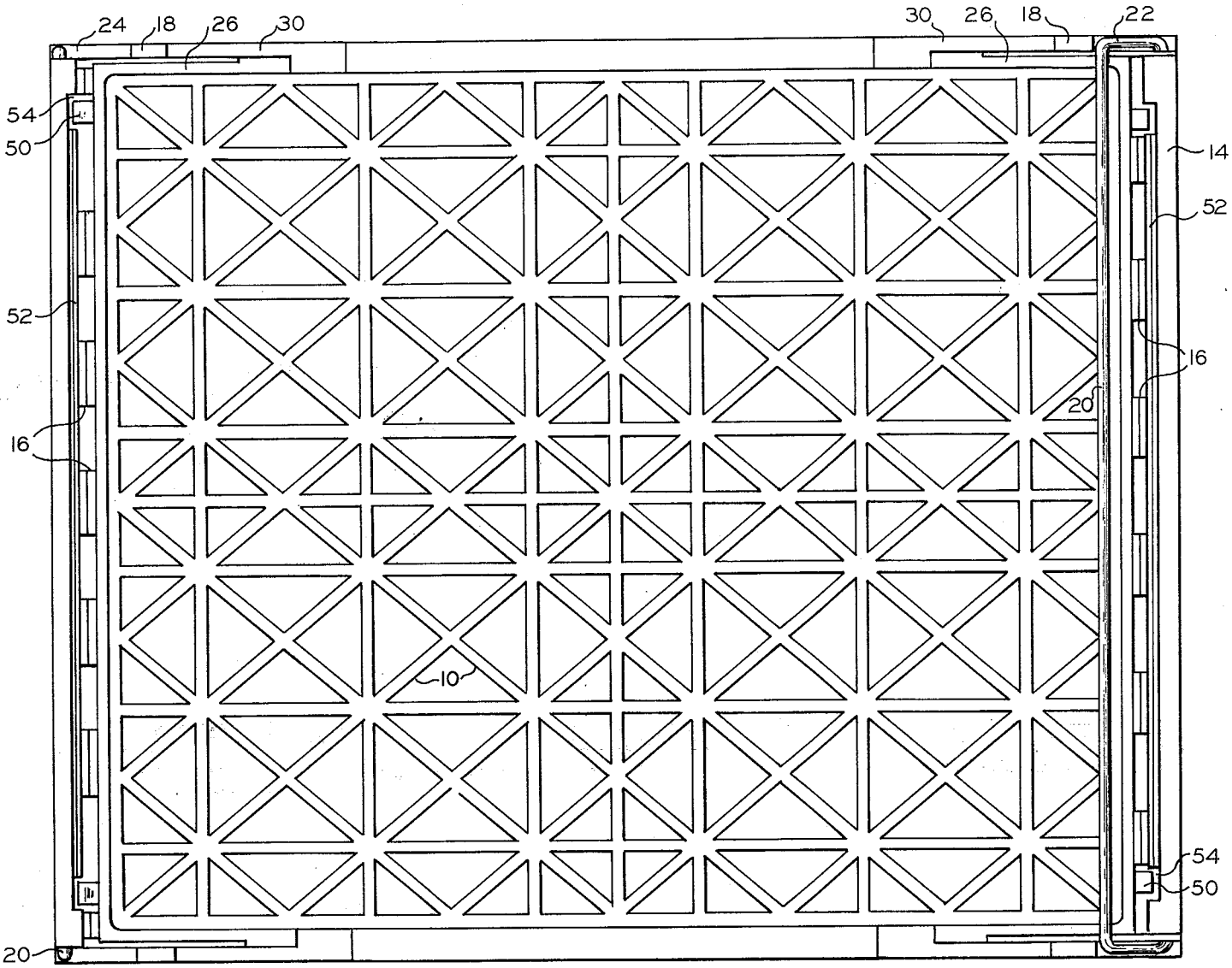
FIG. 2 is a top plan view of the container of FIG. 1.
Figure 3:
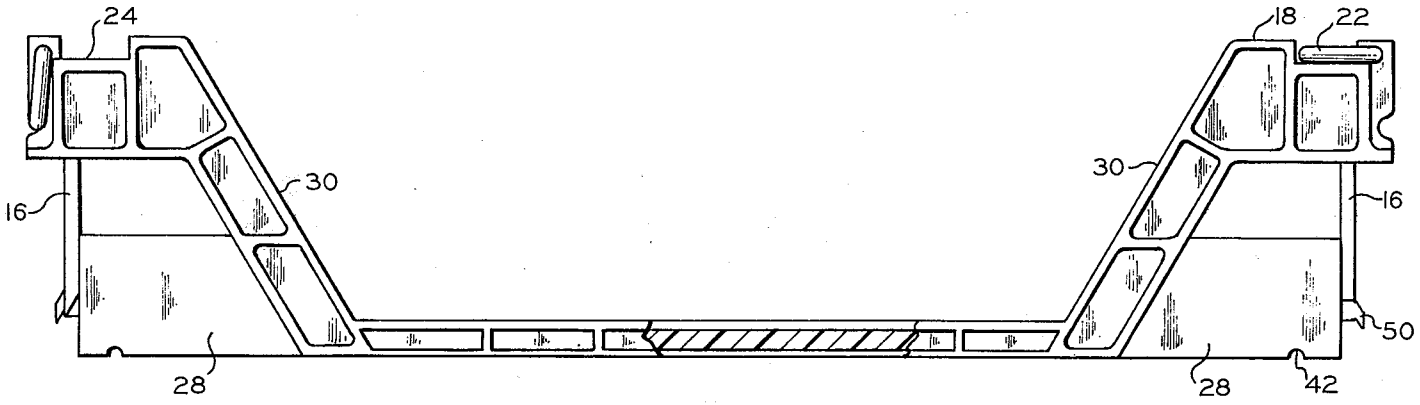
FIG. 3 is a side elevation view of the container of FIG. 1.
Figure 13:
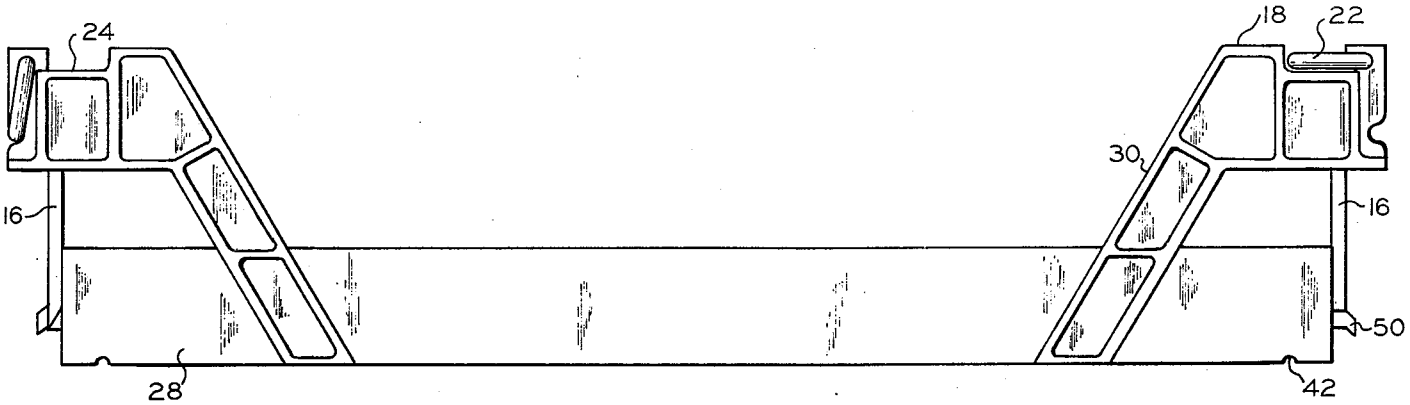

FIG. 13 is a side elevation view illustrating a modification of the container of FIG. 1.

Figure 14:
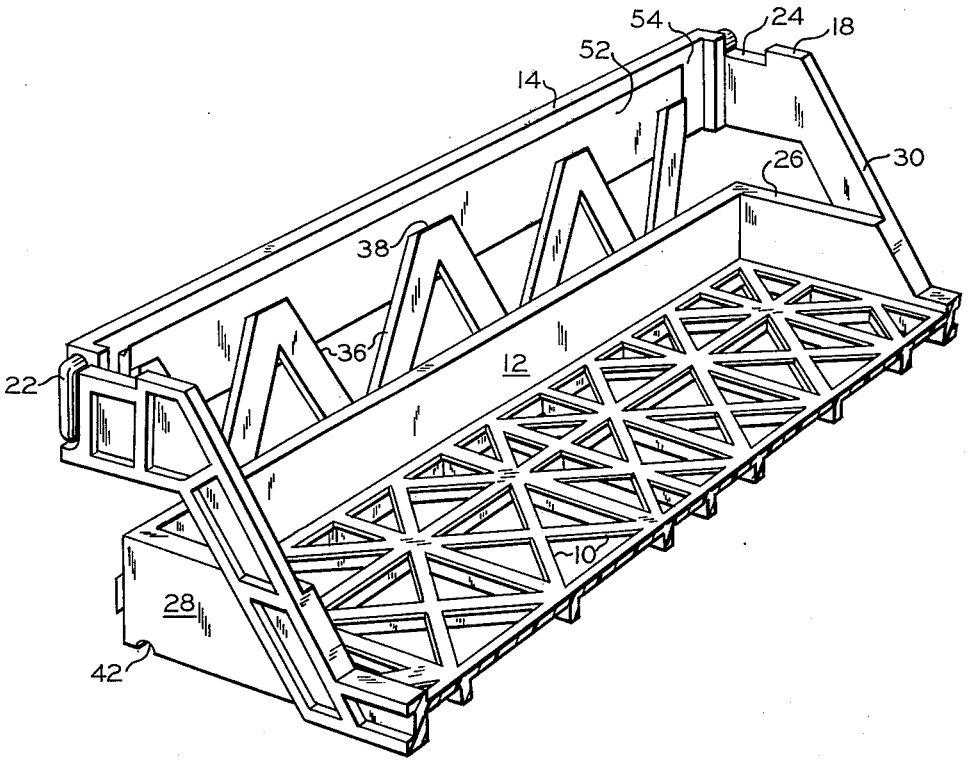

FIG. 14 is a partial top perspective view of another container of the invention.

Figure 15:
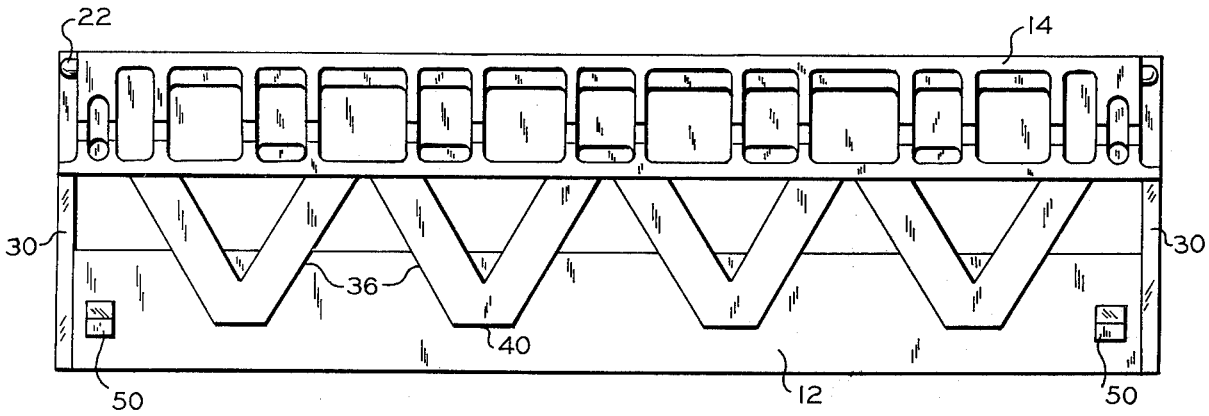

FIG. 15 is an end elevation view looking at the end of the container illustrated in FIG. 14.

Figure 16:
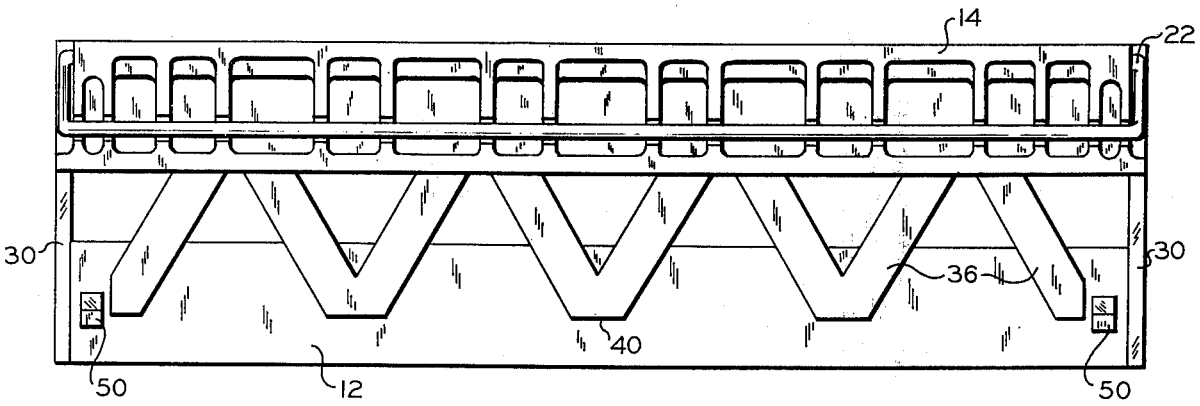

FIG. 16 is an end elevation view of the opposite end (not shown) of the container of FIG. 14.

Referring now to the drawings, wherein like reference numerals are employed to denote like elements, the containers of the invention will be more fully described. In FIGS. 1–12, the container there illustrated comprises, in one embodiment of the invention, a generally rectangular container. Said container is provided with a generally horizontally disposed bottom. Said bottom will preferably comprise a suitable gridwork, here denoted generally by the reference numberal 10. Said bottom can comprise any other suitable bottom means such as a planar sheet, a perforated planar sheet, etc.

First and second opposed wall structures project upwardly from opposing first and second sides of said bottom, respectively. Preferably, each of said wall structure will comprise a border flange 12 which extends along a said side of said bottom and projects upwardly above the plane of said bottom in a first vertical plane which is located adjacent said side of said bottom. Preferably, each of said border flanges 12 extends below the plane of said bottom a short distance. See FIGS. 6–9. An upper rim 14 is disposed generally vertically above each said border flange 12.

Preferably, each of said wall structures also comprises a plurality of spaced apart bar members 16 which extend in an upwardly direction between said border flange 12 and said upper rim 14. Said bar members are disposed in a second vertical plane which is located adjacent but outside (with respect to the container) said first vertical plane. Said upper rim 14 is disposed in a third vertical plane located adjacent but outside said second vertical plane.

The number and positioning of the vertical bar members in the containers of FIGS. 1–12 is not critical. All that is required is that the bar members and spacing of a first wall structure must be arranged with respect to the bar members and spaces of an opposed second wall structure so that the bar members of said first wall structure will be received into the spaces of said second wall structure when an upper container is rotated for low-level stacking within a like lower container, and the bottoms of the bars of an upper container will rest on the tops of the bars of a like oriented lower container for intermediate-level stacking within said lower container, as described further hereinafter.

A plurality of stacking feet are provided at spaced apart locations along said border flange and are disposed in said second vertical plane. Preferably, said stacking feet are provided on the lower ends of said bar members. However, it is within the scope of the invention for said stacking feet to be provided at locations other than on the lower ends of said bar members. For example, the number of said bar members can be reduced and a stacking foot only provided on said border flange, e.g., at a location(s) here illustrated as occupied by a bar member. Similarly, a plurality of stacking saddles are provided at spaced apart locations along said upper rim 14 and are also disposed in said second vertical plane. Preferably, said stacking saddles are provided on the upper ends of said bar members. However, as with said stacking feet, it is within the scope of the invention for said stacking saddle(s) to be provided at location(s) other than on the upper ends of said bar members. For example, the number of said bar members can be reduced and a stacking saddle only provided at location(s) here illustrated as occupied by a bar member.

At each end of said upper rim 14, there is provided a support means which extends inwardly and generally perpendicular from said upper rim. Thus, in the preferred embodiments of the invention, there are provided a pair of support means, one located at one end of said upper rim 14 and the other located at the other end of said upper rim, and each extends inwardly and generally perpendicularly from said upper rim 14. Each of said support means can comprise a segmental upper rim 18 which extends from one of said upper rims 14 a distance at least sufficient to provide support for a bail member described hereinafter.

An elongated generally U-shaped ball member 20 is pivotally mounted at the ends thereof in opposite ends of said upper rim 14. Preferably, said bail member comprises an elongated, essentially straight, intermediate portion designated by said reference numeral 20 and is preferably formed of a heavy metal rod, e.g., a spring steel, having a degree of stiffness which is sufficient, when supported at its ends, to support another loaded container in its middle without appreciable sag or bending. Each bail member is bent, at each end of the intermediate portion thereof, at a right angle to form a connecting portion 22. Said connecting portion 22 is provided with a hinge portion on the end thereof which extends at a right angle thereto so as to permit insertion into an opening provided in the ends of said upper rim 14. Said bail member is adapted to swing about its pivotal axis to occupy (a) a first position internal of said container and resting on said support means 18 so as to provide support for an upper container stacked above a lower container, or (b) a second position external of said container and adjacent the outer surface of said upper rim so as to permit another container of like construction to be stacked within said container. Preferably, said segmental upper rim 18 is provided with a recessed area 24 therein for receiving said bail member when it is pivoted to said first position. It is within the scope of the invention for said bail members to have a structure other than that specifically described above. For example, said bail members can be more arcuate in structure and extend more inwardly of the container. Also, said bail members can be formed of materials other than metal and can have a shape other than that of a rod. The only requirement is that said bail members be adapted to support an upper container in a high-stack relationship.

A third border flange 26 extends along a third side of said bottom, between and generally perpendicular to said border flanges 12 in said first and second wall structures, and projects upwardly above the plane of said bottom 10 in a first vertical plane which is located adjacent said third side of said bottom. A fourth border flange 28 extends along a fourth side of said bottom, between and generally perpendicular to said border flanges 12 in said first and second wall structures, and projects upwardly above the plane of said bottom in a first vertical plane which is located adjacent said fourth side of said bottom. As shown in the drawings, and particularly in FIG. 1, said support means comprising said segmental rims 18 are disposed generally above said third border flange 26 and said fourth border flange 28, and are disposed in vertical planes which are adjacent but outside the vertical planes in which said border flanges are disposed. Preferably, a brace member 30 (preferably inclined) extends downwardly from the end of each said segmental upper rim 18 to the said third or fourth border flange located therebelow.

In one preferred embodiment, the central portions of said third border flange 26 and said fourth border flange 28 between said brace members 30 project upwardly a distance less than about one-half the height of said border flanges 12 in said first and second wall structures. This provides an open area for product inspection and/or product removal. It is preferred that the portions of said border flanges 26 and 28 which are adjacent said border flanges 12 be of the same height as said border flanges 12. It is also preferred that said border flanges 26 and 28 extend below the plane of bottom 10 the same distance as said border flanges 12. FIG. 13 illustrates another embodiment of the invention wherein said border flanges 26 and 28 project upwardly the same height throughout their length as said border flanges 12. Either vertical or inclined bar members can be employed in this embodiment of the invention.

The bottoms and the tops of said bar members, which bottoms and tops comprise said stacking feet and said stacking saddles, respectively, can be essentially flat surfaces. However, it is preferred that the bottoms of said bar members be provided with an upwardly extending and downwardly open recess 32 therein. Preferably, said recess 32 can be formed in one side of the bottom of a said bar member, with a said border flange 12 forming one side of said recess. See FIGS. 6, 8, and 9. Thus, in the preferred embodiments of the invention, each said stacking foot in said pluralities of stacking feet comprises a recess in the bottom of one of said bar members. Similarly, it is preferred that the tops of each of said bar members be provided with an elevated crown 34 having a shape generally corresponding to the shape of said recesses 32 in the bottoms of said bar members. Preferably, said elevated crown 34 can be formed on one side of the tops of said bar members, e.g., the side in which said recess 32 is formed. See FIGS. 6, 8, and 9. Thus, in the preferred embodiments of the invention, each said stacking saddle in said pluralities of stacking saddles comprises an elevated crown formed on top of one of said bar members. As mentioned above, it is within the scope of the invention for said stacking feet and said stacking saddles to be provided at locations other than on the bottoms and tops, respectively, of said bar members. When said stacking feet and said stacking saddles are so provided, it is preferred that they be provided with said recessed and crowned structure.

The containers illustrated in FIGS. 1–12 are provided with bar members 16 which extend vertically between a border flange 12 and an upper rim 14. However, it is within the scope of the invention for the containers to be provided with bar members which extend upwardly in a direction which is inclined with respect to the vertical. Such containers are illustrated in FIGS. 14, 15, and 16. Preferably, said inclined bar members 36 in said wall structures are successively inclined in opposite directions with respect to each other, with adjacent bar members being joined at the adjacent ends thereof to provide a series of alternate generally V-shaped forms and inverted generally V-shaped forms.

When adjacent inclined bar members are joined at adjacent ends thereof to form said V-shaped forms, the apex area of each of said inverted generally V-shaped forms comprises a stacking saddle 38 in a plurality of stacking saddles provided at spaced apart locations along a said upper rim 14 and in a said second vertical plane. The upper end of single inclined bar members also comprises a said stacking saddle. See FIG. 14. Similary, the apex area of each of said generally V-shaped forms comprises a stacking foot 40 in a plurality of stacking feet provided at spaced apart locations along a said border flange 12 and disposed in a said second vertical plane. The lower ends of single inclined bars also comprises a stacking foot. See FIGS. 15 and 16.

Preferably, said apex areas of both types of said V-shaped forms are generally horizontal. Preferably, each of said apex areas comprising a stacking foot 40, or a stacking saddle 38, is provided with the recess or crown structure, respectively, described above in connection with said vertically extending bars.

The containers of the invention provided with vertically extending bar members in the opposing first and second wall structures will stack at said low-level stack position with the bottoms of the border flanges of the upper container resting on the tops of the border flanges of the lower containers when said upper container is in a rotated orientation, i.e., 180°, with respect to said lower container. Any number of said containers can be so stacked so long as atlernate upper containers are rotated 180° with respect to the adjacent lower container. It is preferred that this low-level stack height (the total height of the border flange) be at least one half the intermediate stack height (the length of the vertical bars), and preferably slightly more than one-half, when more than two trays are to be so stacked. Otherwise, the third tray will stack on the ends of the vertical bars.

The containers of the invention provided with vertically extending bar members in the opposing first and second wall structures thereof will stack at the intermediate-level stack position on the tops of said vertical bars when an upper container is in like orientation with respect to a lower container. Any number of said containers can be so stacked as long as the upper container is in like orientation with respect to an adjacent lower container.

The containers of the invention are stacked in the high-level stack position by means of bail menber 20. The high-level stack position is illustrated in FIG. 12. As there shown, said bail member 20 is pivoted about its pivotal axis to occupy a position internal of said container with the connecting portion 22 of bail member 20 resting in recess 24 of support member 18. In said high-level stack position illustrated in FIG. 12 groove 42 of the upper container registers with bail member 20, as shown.

The stacking of the containers of the invention provided with inclined bar members in the opposing first and second wall structures thereof differs from that of the containers of the invention provided with vertical bar members in said wall structures. Said containers of the invention having inclined bar members in said wall structures will stack at said low-level stack position, e.g., with the bottoms of the border flanges of the upper container registering with the tops of the border flanges of the lower container when said upper container is in a position of like orientation with respect to the lower container. Any number of the containers can be so stacked so long as the upper container is in said position of like orientation with respect to the lower container. The V-shaped forms coincide with each other with the inclined bar members comprising said V-shaped forms paralleling each other. The use of inclined bar members permits the low-level stack height to be less than one-half the intermediate-level stack height.

The containers of the invention provided with said inclined bar members in said wall structures thereof will stack at said intermediate-level position on the tops of the inclined bars, i.g., the apex areas formed by joining of adjacent ends of adjacent bars, when an upper container is in rotated orientation, i.e., 180°, with respect to a lower container. Any number of said containers can be so stacked so long as alternate upper containers are rotated 180° with respect to the adjacent lower container.

The containers of the invention provided with said inclined bar members in said wall structures thereof will stack at the high-level stack position in the same manner as described above in connection with the containers having vertical bar members in said wall structures thereof.

From the above descriptions of the containers of the invention, and the stacking features thereof, it is clear that the location, arrangement, and directional disposition of said bar members of said first wall structure and said bar members of said second opposing wall structure, with respect to each other, together with the location, arrangement, and lateral spacing of said stacking feet and said stacking saddles in said first wall structure, and said stacking feed and said stacking saddles in said second wall structure, with respect to each other, are such that an upper said container will stack within a like lower container and on the border flange thereof in a low-stack position or relationship when said upper container is in one of the positions of (1) identical orientation with respect to said lower container and (2) rotated orientaion with respect to said lower container, and an upper said container will stack within a like lower container in an intermediate-stack position or relationship when said upper container is in the other of said positions (1) and (2).

If desired, the containers of the invention, both those provided with vertical bar members and those provided with inclined bar members in the wall structures thereof, can be provided with "blind stacking" means for stacking the containers at the low-level stacking position and the intermediate-stacking position. This feature of the containers of the invention will be described with particular reference to the embodiments illustrated in FIGS. 1–12. However, it will be understood by those skilled in the art in view of this description how this feature can also be provided in the containers illustrated in FIGS. 14–16.

Referring again to FIG. 1, in the containers provided with said blind stacking means, a guide means projects outwardly from said border flanges 12 in the opposing first and second wall structures. As here illustrated, said guide means comprises two spaced apart guide lugs 50 located adjacent the opposite ends of said border flanges 12. Preferably, said guide lugs are provided with an upwardly extending and downwardly open recess 51 in the bottoms thereof. A guide rail 52 is secured to the inner wall surface of each of said upper rims 14 in said opposing first and second wall structures. Preferably, the top of each of said guide rails is provided with an elevated crown 53 formed on one side thereof, similarly as described above for said bar members. A clearway means is provided with said guide rail and is adapted to accommodate said guide means during stacking of an upper container within a like lower container. As here illustrated, said clearway means comprises two spaced apart clearways 54 located at the opposite ends of said guide rail. It will be understood that said guide rail 52 can, if desired, extend essentially the full length of said upper rims 14, with said clearway 54 being provided in said guide rail adjacent the ends thereof, or at other suitable locations depending upon the spacing and lateral placement of said guide lugs 50. Thus, the spacing and lateral placement of said clearways 54 in the guide rails 52 in said first and second wall structures with respect to the spacing and lateral placement of the guide lugs 50 of said first and second wall structure is such that an upper said container will stack within a like lower container when said upper container is in either of said positions of (1) identical orientation with respect to said lower container and (2) rotated orientation with respect to said lower container. As illustrated, in those embodiments of the invention provided with blind stacking means, the upper end portions of the bar members in the first and second opposing wall structures are secured to the inner wall surface of said guide rails, with the lower end portions of said bar members being secured to the outer wall surface of said border flanges.

The blind stacking feature of the containers of the invention is of great value when the containers are being stacked to any height at which it is inconvenient to lift the upper container to a position directly above the lower container. In such instances, the stacking operation can be initiated by placing an upper container upon a lower container, preferably at a slight tilt so as to bring the recesses 51 in the bottoms of guide lugs 50 in resiter with the crowns 53 of the guide rails, and then moving the upper container across the lower container until the bottom periphery of the upper container is within the top periphery of the lower container. Said recesses and crowns thus cooperate in a sliding engagement in guiding the upper container into proper position for stacking within a lower container. The just described operation can be considered a "prestacking" operation. When the upper container is oriented for stacking within the lower container and the bottom periphery of the upper container is within the top periphery of the lower container, said guide lugs 50 will be accommodated by and pass through the clearways 54, and the upper container will drop into the lower container into one of the above-described low-stack or intermediate-stack positions. In the containers of FIGS. 1–12, when the upper container is in rotated orientation, i.e., 180° with respect to the lower container, said upper container will drop into said lower container until the bottoms of the border flanges 12 of the upper container register with and are supported on the tops of the border flanges 12 of the lower container, and the containers will be stacked in low-stack position or relationship. When said upper container is in a position of like orientation with respect to the lower container, said upper container will drop in to the lower container until the bottoms of the bar members (stacking feet) of the upper container register with the tops of the bar members (stacking saddles) of the lower container, and the containers will be in the intermediate-stack position or relationship. It will be noted that the level of the crowns 53 on the guide rails 52 is higher than the level of the crowns 34 on the tops of the bar members. See FIGS. 6–9.

The above-described "blind stacking" can be readily carried out without visual observation of the guide rails and the stacking feet or the stacking saddles by an operator because it is only necessary that the operator place the recesses 51 in the guide lugs 50 into register with the crowns 53 on guide rails 52 and proceed as described above. This can be readily accomplished because the span or width of said recesses 51 in the guide lugs 50 is great enough to span both the crowns 53 on the guide rails 52 and the crowns 34 on the top of the bar members when the latter crowns are provided.

The containers of the invention can be fabricated in any suitable manner known to the art. Injection molding, for example, is one presently preferred method for fabricating said containers. Said containers can be fabricated from any suitable material. High density polyethylenes are especially desirable materials from which to fabricate said containers. The high density polyehtylenes prepared by the methods disclosed and claimed by J. p. Hogan et al. in U.S. Pat. No. 2,825,721, issued Mar. 4, 1958, comprise one group of presently preferred materials. Said containers can also be fabricated from butadiene-styrene coplymers, and other plastic materials. If desired, a reinforcing fibrous material, such as asbestos or glass fibers, can be incorporated in the plastic material. While the various plastics are presently preferred for the manufacture of the containers, it is within the scope of the invention to fabricate said containers from other materials, e.g., lightweight metals such as aluminum, reinforced pulp materials, etc.

As an example, one model of a container fabricated in accordance with the invention had an overall length of about 26.5 inches, an overall width of about 22.5 inches, and an overall height of about 6.5 inches. Guide lugs had a width of about 0.6 inch. The inclined bars in the wall of the container were approximately 4.5 inches in legnth. The upper surface of the T bars in the gridwork bottom was approximately ¼-inch wide. The dimensions of the other elements of the container were generally proportional in size. The above dimensions are given by way of example only and are not to be construed as limiting on the invention.

Herein and in the claims, the word "rectangular" has been employed generically to include four-sided structures which are generally square and four-sided structures wherein one pair of sides is longer than the other pair of sides.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

I claim:

1. A generally rectangular container adapted for stacking with another like container at three levels, said container comprising, a generally horizontally disposed bottom, and first and second opposed wall structures projecting upwardly from opposing first and second sides of said bottom, respectively with each of said wall structures comprising, in combination:

a border flange extending along a said side of said bottom and projecting upwardly above the horizontal plane of said bottom in a first vertical plane located adjacent said side of said bottom;

an upper rim spaced from and disposed generally vertically above said border flange;

a plurality of spaced apart bar members extending vertically between the outer surface of said border flange and the inner surface of said upper rim, said bar members being disposed in a second vertical plane located adjacent but outside said first vertical plane, and said upper rim being disposed in a third vertical plane located adjacent but outside said second vertical plane, with the bar members and spacing thereof in one of said opposed wall structures being arranged with respect to the bar members and spacing thereof in the other of said wall structures so that an upper said container will stack in a low-stack position within a reversely oriented lower like container on the border flange of said lower container and with the bar members in the wall structures of said upper container occupying open spaces in the wall structures of said lower container, but will stack in an intermediate-stack position on a like oriented lower container as deescribed hereinafter;

a plurality of stacking saddles provided on the tops of a like plurality of said bar members;

a plurality of stacking feet provided on the bottoms of a like plurality of said bar members for registering in vertical alignment with a said plurality of stacking saddles on a said like oriented lower container and supporting a said upper container on a lower container in said intermediate-stack position;

an elongated generally U-shaped bail member pivotally mounted at the ends thereof in opposite ends of said upper rim and adapted to swing about its pivotal axis to occupy (a) a position internal of said container and resting on said support means described hereinafter so as to support an upper container stacked above a container or (b) a position adjacent the outer surface of said upper rim and external of said container so as to permit another container of like construction to be stacked within said container; and at each end of said upper rim, a said support means extending inwardly and generally perpendicular therefrom for supporting said bail member in said position internal of said container.

2. A container according to claim 1 wherein:

a third border flange extends along a third side of said bottom, between and generally perpendicular to said border flanges in said first and second wall structures, and projects inwardly above the plane of said bottom in a first vertical plane located adjacent said third side of said bottom;

a fourth border flange extends along a fourth side of said bottom, between and genrally perpendicular to said border flanges in said first and second wall structures, and projects upwardly above the plane of said bottom in a first vertical plane located adjacent said fourth side of said bottom;

each of said support means, located at each end of each of said upper rims in said first and second wall structures, commprises a segmental upper rim extending from one of said upper rims above one of said third or fourth border flanges a distance at least sufficient to provide support for said bail member; and an inclined brace member extends between each said segmental upper rim and the outer surface of the said third or fourth border flange located therebelow.

3. A container according to claim 2 wherein said third and fourth border flanges each projects upwardly throughout its length to the same height as the border flanges in said first and second wall structures.

4. A container according to claim 2 wherein the central portion of each of said third and fourth border flanges projects upwardly to a height less than about one-half the height of the border flanges in said first and second wall structures.

5. A generally rectangular container adapted for stacking with another like container at three levels, said container comprising, a generally horizontally disposed bottom, and first and second opposed wall structures projecting upwardly from opposing first and second sides of said bottom, respectively, with each of said wall structures comprising, in combination:

a border flange extending along a said side of said bottom and projecting upwardly above the horizontal plane of said bottom in a first vertical plane located adjacent said side of said bottom;

an upper rim spaced from and disposed generally vertically above said border flange;

a plurality of spaced apart inclined bar members extending in an upwardly direction between the outer surface of said border flange and the inner surface of said upper rim, said bar members being disposed in a second vertical plane located adjacent but outside said first vetical plane, and said upper rim being disposed in a third vertical plane located adjacent but outside said second vertical plane, whereby an upper said container will stack in a low-stack position within a like oriented lower like container on the border flange of said lower container and with the bar members of corresponding wall structures paralleling each other, but will stack in an intermediate-stack position on a reversely oriented like lower container as described hereinafter;

a plurality of stacking saddles provided on the tops of a like plurality of said bar members;

a plurality of stacking feet provided on the bottoms of a like plurality of said bar members for registering in vertical alignment with said plurality of stacking saddles on a said reversely oriented like lower container and supporting a said upper container on a lower container in said intermediate-stack position;

an elongated generally U-shaped bail member pivotally mounted at the ends thereof in opposite ends of said upper rim and adapted to swing about its pivotal axis to occupy (a) a position internal of said container and resting on a support means described hereinafter so as to support an upper container stacked above said ccontainer or (b) a position adjacent the outer surface of said upper rim and external of said container so as to permit another container of like construction to be stacked within said container; and at each end of said upper rim, a said support means extending inwardly and generally perpendicular therefrom for supporting said bail member in said position internal of said container.

6. A container according to claim 5 wherein:

a third border flange extends along a third side of said bottom, between and generally perpendicular to said border flanges in said first and second wall structure, and projects upwardly above the plane of said bottom in a first vertical plane located adjacent said third side of said bottom;

a fourth border flange extends along a fourth side of said bottom, between and generally perpendicular to said border flanges in said first and second wall structures, and projects upwardly above the plane of said bottom in a first vertical plane located adjacent said fourth side of said bottom;

each of said support means, located at each end of each of said upper rims in said first and second wall structures, comprises a segmental upper rim extending from one of said upper rims above one of said third or fourth border flanges a distance at least sufficient to provide support for said bail member; and an inclined brace member extends between each said segmental upper rim and the outer surface of the said third or fourth border flange located therebelow.

7. A container according to claim 6 wherein said third and fourth border flanges each projects upwardly throughout its length to the same height as the border flanges in said first and second wall structures.

8. A container according to claim 5 wherein the central portion of each of said third and fourth border flanges projects upwardly to a height less than about one-half the height of the border flanges in said first and second walll structures.

9. A container according to claim 5 wherein:

said bar members are successively inclined in opposite directions with respect to each other, with adjacent bar members joined at the adjacent ends thereof to provide a series of alternate generally V-shaped forms and inverted generally V-shaped forms;

the apex area of each of said inverted generally V-shaped forms comprises a stacking saddle; and the apex area of such said generally V-shaped forms comprises a stacking foot.

10. A generally rectangular container adapted for stacking with another like container at three levels, said container comprising, a generally horizontally disposed bottom, and first and second opposed wall structures projecting upwardly from opposing first and second sides of said bottom, respectively, with each of said wall structures comprising, in combination:

a border flange extending along a said side of said bottom and projecting upwardly above the horizontal plane of said bottom in a first vertical plane located adjacent said side of said bottom;

an upper rim spaced from and disposed generally vertically above said border flange;

a pair of spaced apart guide lugs projecting outwardly from the outer surface of said border flange, one of said lugs being adjacent one end of said flange and the other lug adjacent the other end of said flange;

a guide rail secured to the inner surface of said upper rim for receiving and supporting on its upper surface a said guide lug of a like upper container only during pre-stacking operations;

a plurality of spaced apart bar members extending vertically between the outer surface of said border flange and the inner surface of said guide rail, said bar members being disposed in a second vertical plane located adjacent but outside said first vertical plane, and said guide rail being disposed in a third vertical plane located adjacent but outside said second vertical plane with the bar members in one of said opposed wall structures being located opposite a space not occupied by a bar member in the other of said wall structures, whereby an upper said container will stack in a low-stack position within a reversely oriented lower like container on the border flange of said lower container and with the bar members in the wall structures of said upper container occupying open spaces in the wall structures of said lower container, but will stack in an intermediate-stack position on a like oriented lower container as described hereinafter;

a plurality of stacking saddles provided on the tops of a like plurality of said bar members at an elevation less than that of said upper surface of said guide rail and in said second vertical plane;

a plurality of stacking feet provided on the bottoms of a like plurality of said bar members at an elevation greater than that of said guide lugs for registering in vertical alignment with a said plurality of stacking saddles on a said like oriented lower container and supporting a said upper container on a lower container in said intermediate-stack position;

clearway means provided in said guide rail in vertical alignment with said guide lugs for permitting passage therethrough of said guide lugs of a like upper container during low-stack operations when said stacking feet and stacking saddles are not in vertical alginment and receiving therein said guide lugs of a like upper container in said intermediate-stack position when said stacking feet and said stacking saddles are in vertical alignment;

an elongated generally U-shaped bail member pivotally mounted at the ends thereof in opposite ends of said upper rim and adapted to swing about its pivotal axis to occupy (a) a position internal of said container and resting on a support means described hereinafter so as to support an upper container stacked above said container in a high-stack position or (b) a position adjacent the outer surface of said upper rim and external of said container so as to permit another container of like construction to be stacked within said container in said low-stack and intermediate-stack positions; and at each end of said upper rim, a said support means extending inwardly and generally perpendicular therefrom for supporting said bail member in said position internal of said container.

11. A container according to claim 10 wherein:

a third border flange extends along a third side of said bottom, between and generally perpendicular to said border flanges in said first and second wall structures, and projects upwardly above the plane of said bottom in a first vertical plane located adjacent said third side of said bottom;

a fourth border flange extends along a fourth side of said bottom, between and generally perpendicular to said border flanges in said first and second wall structures, and projects upwardly above the plane of said bottom in a first vertical plane located adjacent said fourth side of said bottom;

each of said support means, located at each end of each of said upper rims in said first and second wall structures, comprises a segmental upper rim extending from one of said upper rims above one of said third or fourth border flanges a distance at least sufficient to provide support for said bail member; and an inclined brace member extends between each said segmental upper rim and the outer surface of the said third or fourth border flange located therebelow.

12. A container according to claim 11 wherein said third and fourth border flanges each projects upwardly throughout its length to the same height as the border flanges in said first and second wall structures.

13. A container according to claim 11 wherein the central portion of each of said third and fourth border flanges projects upwardly to a height less than about one-half the height of the border flanges in said first and second wall structures.

14. A generally rectangular container adapted for stacking with another like container at three levels, said container comprising, a generally horizontally disposed bottom, and first and second opposed wall structures projecting upwardly from opposing first and second sides of said bottom, respectively, with each of said wall structures comprising, in combination:

a border flange extending along a said side of said bottom and projecting upwardly above the horizontal plane of said bottom in a first vertical plane located adjacent said side of said bottom;

an upper rim spaced from and disposed generally vertically above said border flange;

a pair of spaced apart guide lugs projecting outwardly from the outer surface of said border flange, one of said lugs being adjacent one end of said flange and the other lug adjacent the other end of said flange;

a guide rail secured to the inner surface of said upper rim for receiving and supporting on its upper surface a said guide lug of a like upper container only during pre-stacking operations;

a plurality of spaced apart inclined bar members extending in an upwardly direction between the outer surface of said border flange and the inner surface of said guide rail, said bar members being disposed in a second vertical plane located adjacent but outside said first vertical plane, and said guide rail being disposed in a third vertical plane located adjacent but outside said second vertical plane, whereby an upper said container will stack in a low-stack position within a like oriented lower like container on the border flange of said lower container and with the bar members of corresponding wall structures paralleling each other, but will stack in an intermediate-stack position on a reversely oriented like lower container as described hereinafter;

a plurality of stacking saddles provided on the tops of a like plurality of said bar members at an elevation less than that of said upper surface of said guide rail and in said second vertical plane;

a plurality of stacking feet provided on the bottoms of a like plurality of said bar members at an elevation greater than that of said guide lugs for registering in vertical alignment with a said plurality of stacking saddles on a said like oriented lower container and supporting a said upper container on a lower container in said intermediate-stack position;

clearway means provided in said guide rail in vertical alignment with said guide lugs for permitting passage therethrough of said guide lugs of a like upper container during low-stack operations when said stacking feet and stacking saddles are not in vertical alignment and receiving therein said guide lugs of a like upper container in said intermediate-stack position when said stacking feet and said stacking saddles are in vertical alignment;

an elongated generally U-shaped bail member pivotally mounted at the ends thereof in opposite ends of said upper rim and adapted to swing about its pivotal axis to occupy (a) a position internal of said container and resting on a suppport means described hereinafter so as to support an upper container stacked above said container in a high-stack position or (b) a position adjacent the outer surface of said upper rim and external of said container so as to permit another container of like construction to be stacked within said container in said low-stack and intermediate-stack positions; and at each end of said upper rim, a said support means extending inwardly and generally perpendicular therefrom for supporting said bail member in said position internal of said container.

15. A container according to claim 14 therein:

a third border flange extends along a third side of said bottom, between and generally perpendicular to said border flanges in said first and second wall structures, and projects upwardly above the plane of said bottom in a first vertical plane located adjacent said third side of said bottom;

a fourth border flange extends along a fourth side of said bottom, between and generally perpendicular to said border flanges in said first and second wall structures, and projects upwardly above the plane of said bottom in a first vertical plane located adjacent said fourth side of said bottom;

each of said support means, located at each end of each of said upper rims in said first and second wall structures, comprises a segmental upper rim extending from one of said upper rims above one of said third or fourth border flanges a distance at least sufficient to provide support for said bail member; and an inclined brace member extends between each said segmental upper rim and the outer surface of the said third or fourth border flange located therebelow.

16. A container according to claim 15 wherein said third and fourth border flanges each projects upwardly throughout its length to the same height as the border flanges in said first and second wall structures.

17. A container according to claim 14 wherein the central portion of each of said third and fourth border flanges projects upwardly to a height less than about one-half the height of the border flanges in said first and second wall strcutures.

18. A container according to claim 14 wherein:

said bar members are successively inclined in opposite directions with respect to each other, with adjacent bar members joined at the adjacent ends thereof to provide a series of alternate generally V-shaped forms and inverted generally V-shaped forms;

the apex area of each of said inverted generally V-shaped forms comprises a stacking saddle; and the apex area of each of said generally V-shaped forms comprises a stacking foot.

* * * * *

UNITED STATES PATENT AND TRADEMARK OFFICE

CERTIFICATE OF CORRECTION

PATENT NO. : 3,951,265

DATED : April 20, 1976

INVENTOR(S) : James C. Carroll

It is certified that error appears in the above-identified patent and that said Letters Patent are hereby corrected as shown below:

Column 10, claim 1, line 8, the word "said" should be --- a ---; line 10, the word "a" should be --- said ---; claim 2, line 23, the word "inwardly" should be --- upwardly ---.

Column 11, claim 6, line 41, the word "structure" should be --- structures.

Column 12, claim 9, line 12, instead of "such" the words --- each of --- should be inserted.

Column 14, claim 15, line 62, "therein" should be --- wherein ---.

Signed and Sealed this

Third Day of May 1977

[SEAL]

*Attest:*

RUTH C. MASON
*Attesting Officer*

C. MARSHALL DANN
*Commissioner of Patents and Trademarks*